US006619748B1

(12) United States Patent
Tseng

(10) Patent No.: US 6,619,748 B1
(45) Date of Patent: Sep. 16, 2003

(54) CHAIR HAVING A CRANK MECHANISM FOR MOVING A FOOTREST BETWEEN EXTENDED AND RETRACTED POSITIONS RELATIVE TO A SEAT

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/217,747

(22) Filed: Aug. 13, 2002

(51) Int. Cl.[7] ..... A47C 7/50
(52) U.S. Cl. ..... 297/423.3; 297/69
(58) Field of Search ..... 297/69, 70, 75, 297/375, 374, 423.3, 423.36, 423.35, 423.26

(56) References Cited

U.S. PATENT DOCUMENTS 4,270,796 A * 6/1981 Preston ..... 297/69
4,506,925 A * 3/1985 Crum ..... 297/69
4,572,573 A * 2/1986 Yoshikawa et al. ..... 297/75
4,915,444 A * 4/1990 Rogers, Jr. ..... 297/68
5,087,094 A * 2/1992 Rogers, Jr. ..... 297/68
5,368,366 A * 11/1994 Mizelle ..... 297/423.3
5,782,535 A * 7/1998 Lafer ..... 297/423.36
6,382,727 B1 * 5/2002 Pickard ..... 297/423.36

* cited by examiner

*Primary Examiner*—Peter M. Cuomo
*Assistant Examiner*—Stephen D'Adamo
(74) *Attorney, Agent, or Firm*—Ladas & Parry

(57) ABSTRACT

A chair includes a seat mounted on a base, a backrest disposed behind the seat, and a linkage unit interconnecting the seat and a footrest via a support unit. A shaft is rotatably mounted on the seat. The linkage unit includes a first crank arm secured to the shaft for synchronous rotation therewith, a second crank arm having a rear end pivoted a distal end of the first crank arm, and a triangular third crank arm having a first corner pivoted to the seat, a second corner pivoted to a front end of the second crank arm, and a third corner. A fourth crank arm has a front end pivoted to the support unit and a rear end pivoted to the third corner such that rotation of the shaft results in turning of the footrest relative to the seat.

2 Claims, 6 Drawing Sheets

CHAIR HAVING A CRANK MECHANISM FOR MOVING A FOOTREST BETWEEN EXTENDED AND RETRACTED POSITIONS RELATIVE TO A SEAT

BACKGROUND OF THE INVENTION

The present invention relates to a chair, more particularly to a chair with an extendible footrest.

SUMMARY OF THE INVENTION

The object of this invention is to provide a chair having a crank mechanism for moving a footrest between extended and retracted positions relative to a seat.

Accordingly, a chair of the present invention includes: a seat base; a seat mounted on the seat base, extending in a longitudinal direction, and having left and right sides, front and rear ends, and a bottom; a backrest disposed rearwardly of and connected to the seat; a footrest disposed frontwardly of the seat; a linkage mounting unit including left and right brackets fixed to the bottom of the seat and extending in the longitudinal direction, each of the left and right brackets having opposite front and rear ends; a shaft mounted rotatably on the rear ends of the left and right brackets and extending in a transverse direction relative to the longitudinal direction; an operating lever secured to the shaft for turning the same; a support unit disposed below and for supporting the footrest thereon; and a linkage unit interconnecting the seat and the support unit, and including a pair of crank mechanisms disposed at the left and right sides of the seat 11, respectively. Each of the crank mechanisms includes a first crank arm, a second crank arm, a third crank arm, and a fourth crank arm. The first crank arm is secured to the shaft for synchronous rotation therewith, extends transversely from the shaft, and has a pivot end distal from the shaft. The second crank arm is disposed frontwardly of the first crank arm, and has a front end and a rear end pivoted to the pivot end of the first crank arm. The third crank arm is of generally triangular shape, is disposed frontwardly of the second crank arm, and has a first corner pivoted to the respective one of the left and right brackets, a second corner pivoted to the front end of the second crank arm and disposed above the first corner, and a third corner disposed above the first corner. The fourth crank arm is disposed frontwardly of the third crank arm, and has a front end pivoted to the support unit, and a rear end pivoted to the third corner of the third crank arm such that rotation of the shaft and the first crank arm via actuation of the operating lever in a first direction results in turning of the third crank arm relative to the respective one of the left and right brackets in the first direction via said second crank arm, which, in turn, results in turning of the footrest relative to the left and right brackets in a second direction opposite to the first direction via the fourth crank arm, thereby stretching out the footrest to an extended position relative to the left and right brackets, and that rotation of the shaft and said first crank arm via actuation of the operating lever in the second direction results in turning of the third crank arm relative to the respective one of the left and right brackets in the second direction via the second crank arm, which, in turn, results in turning of the footrest relative to the left and right brackets in the first direction via the fourth crank arm, thereby folding the footrest to a retracted position relative to the left and right brackets.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
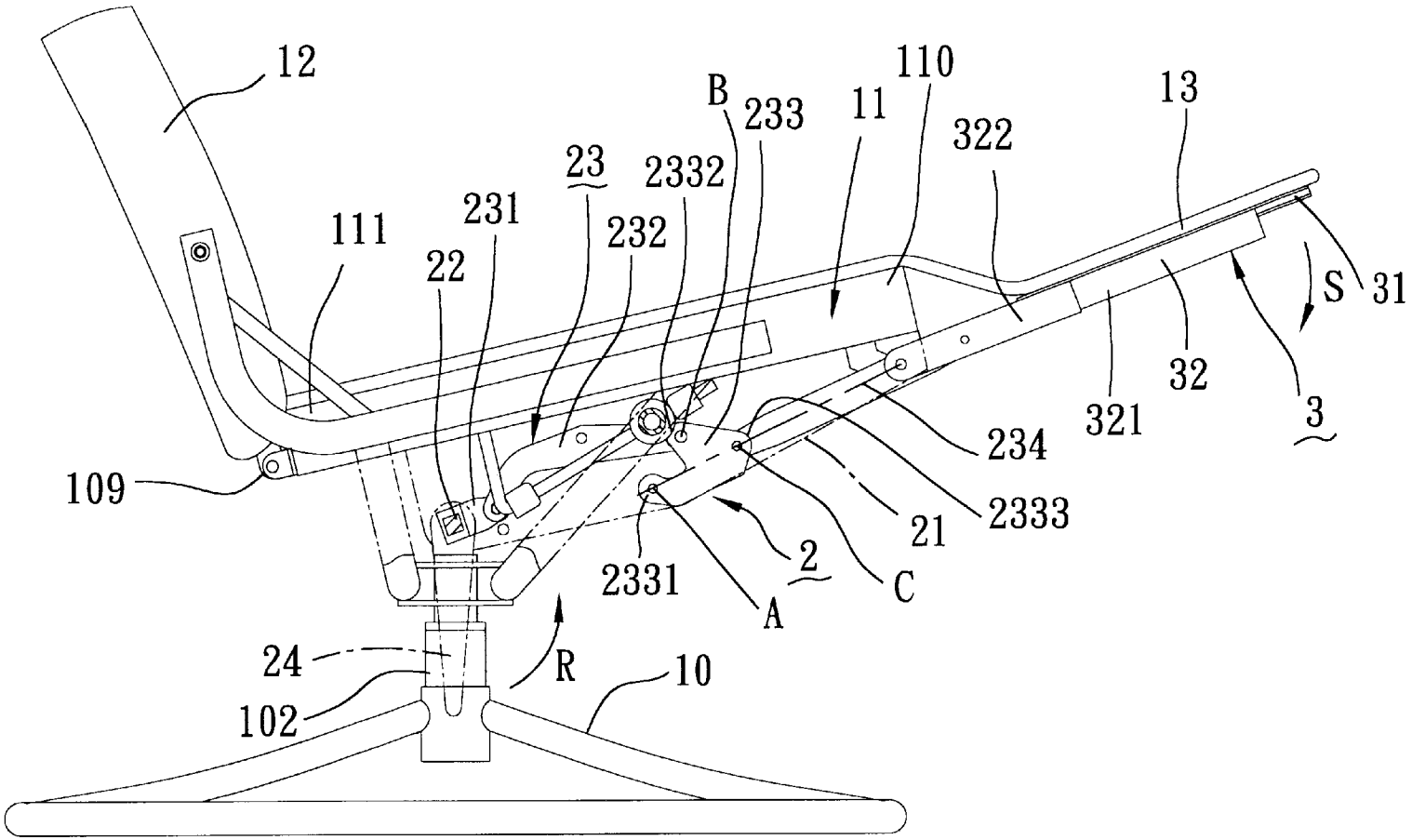
FIG. 1 is a schematic side view of a preferred embodiment of a chair according to the present invention, illustrating a footrest at a fully extended position relative to a seat.
Figure 2:
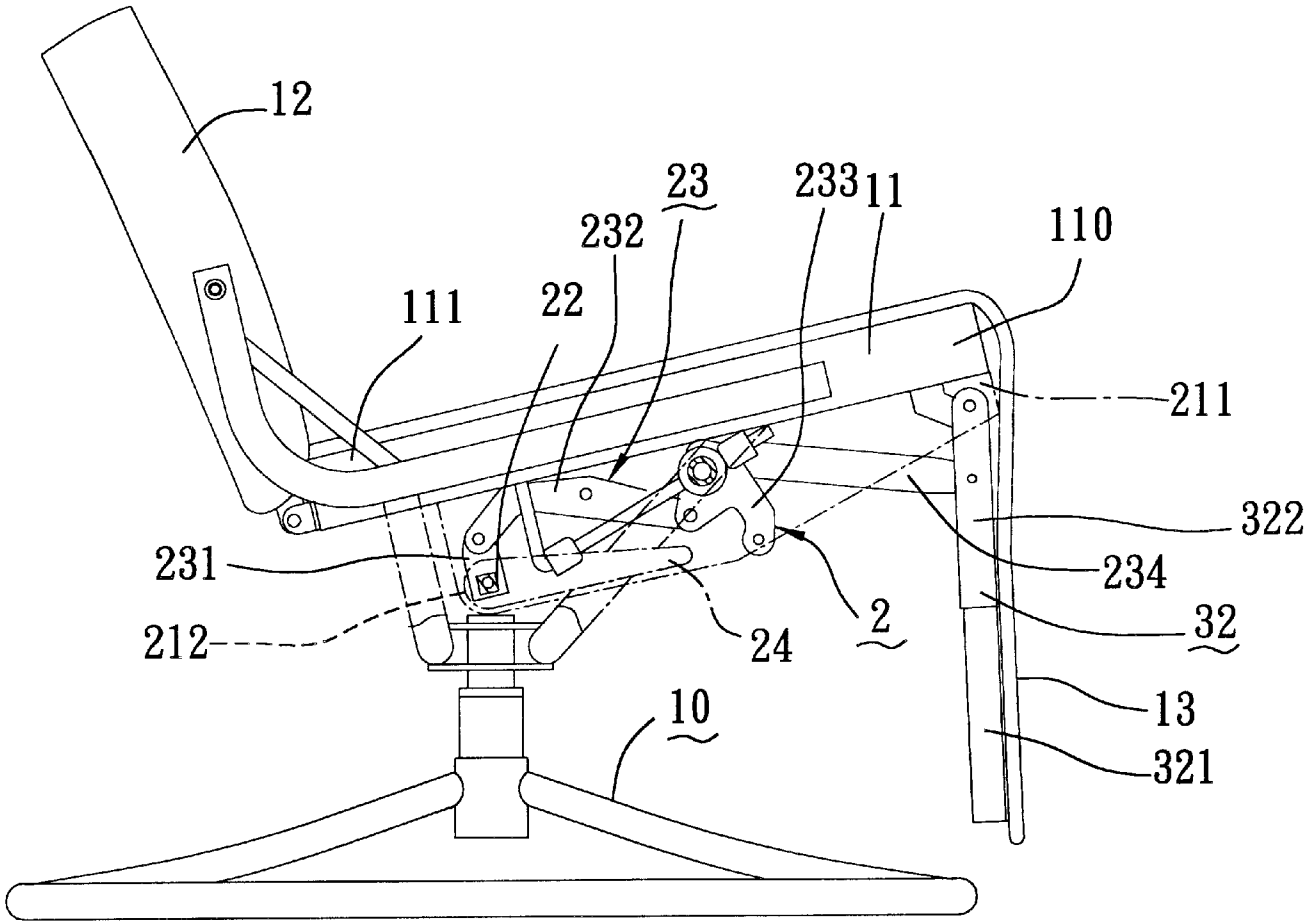
FIG. 2 is a schematic side view of the preferred embodiment, illustrating the footrest at a retracted position relative to the seat.
Figure 3:
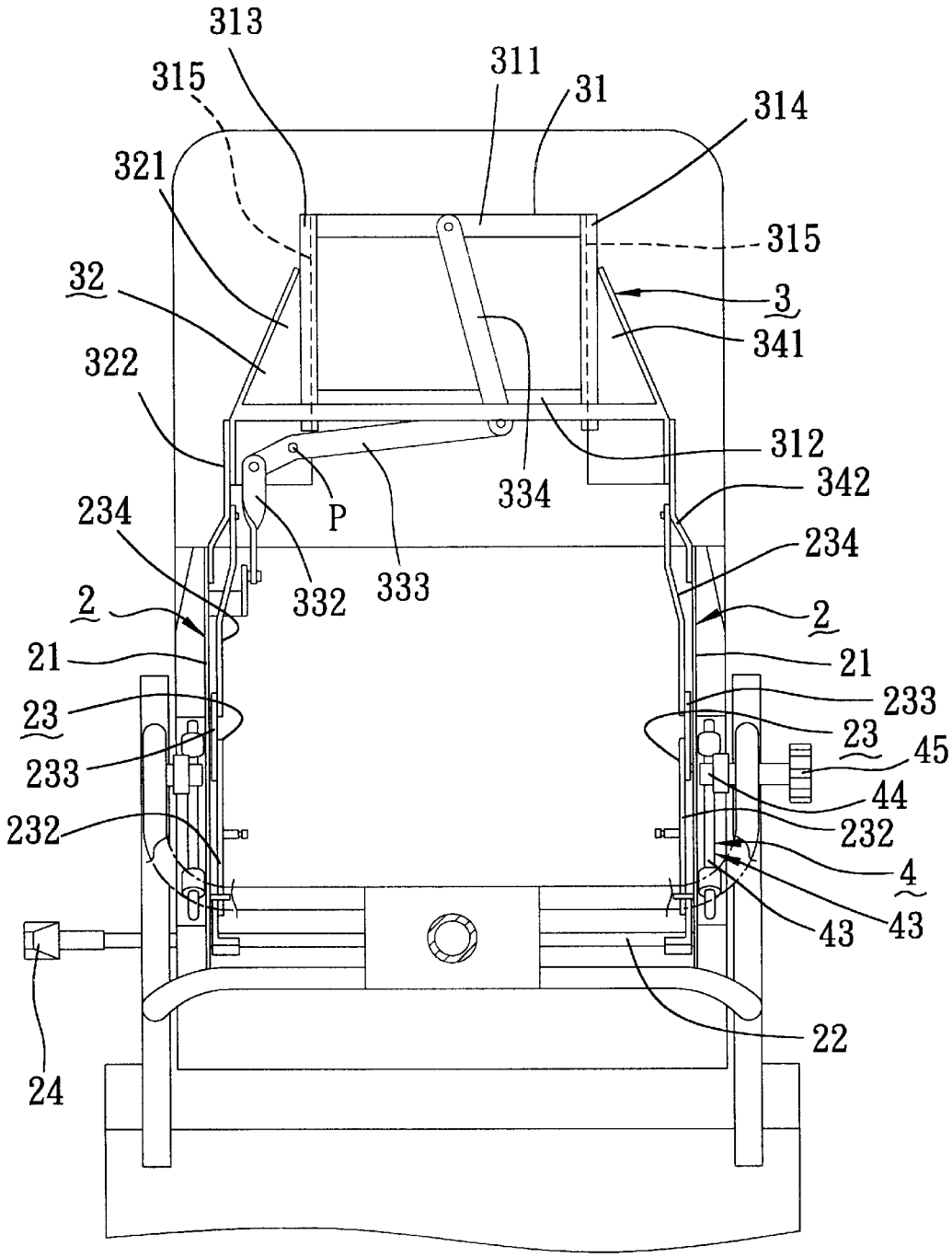
FIG. 3 is a bottom view of the preferred embodiment, illustrating the footrest at the fully extended position.

Referring to FIGS. 1 to 3, the preferred embodiment of a chair according to the present invention is shown to include a seat base 10, a slidable seat 11, a backrest 12, a footrest 13, a linkage mounting unit, a shaft 22, an operating lever 24, a support unit 3, and a linkage unit 2.

As illustrated, the seat 11 is mounted on the seat base 10, extends in a longitudinal direction, and has left and right sides, front and rear ends 110, 111, and a bottom.

The backrest 12 is disposed rearwardly of the seat 11, and has a lower end connected pivotally to the rear end 111 of the seat 11 about a horizontal pivot 109.

The footrest 13 is disposed frontwardly of the seat 11.

The linkage mounting unit includes left and right brackets 21 fixed to the bottom of the seat 11, and extending in the longitudinal direction. Each of the left and right brackets 21 has opposite front and rear ends 211, 212.

The shaft 22 is mounted rotatably on the rear ends 212 of the left and right brackets 21, and extends in a transverse direction relative to the longitudinal direction.

The operating lever 24 is secured to the shaft 22 for turning the same.

The support unit 3 is disposed below and is pivoted to the left and right brackets 21 for supporting the footrest 13 thereon.

The linkage unit 2 interconnects the seat 11 and the support unit 3, and includes a pair of crank mechanisms 23 disposed at the left and right sides of the seat 11, respectively. Each of the crank mechanisms 23 includes a first crank arm 231, a second crank arm 232, a triangular-shaped third crank arm 233, and a fourth crank arm 234. The first crank arm 231 is secured to the shaft 22 for synchronous rotation therewith, extends transversely from the shaft 22, and has a pivot end distal from the shaft 22. The second crank arm 232 is disposed frontwardly of the first crank arm 231, and has a front end, and a rear end pivoted to the pivot end of the first crank arm 231. The third crank arm 233 is disposed frontwardly of the second crank arm 232, and has a first corner 2331 pivoted to a respective one of the left and right brackets 21 about a first pivot pin (A), a second corner 2332 pivoted to the front end of the second crank arm 232 about a second pivot pin (B) and disposed above the first corner 2331, and a third corner 2333 disposed above the first corner 2331. The fourth crank arm 234 is disposed frontwardly of the third crank arm 233, and has a front end pivoted to the support unit 3 and a rear end pivoted to the third corner 2333 of the third crank arm 233 about a third pivot pin (C) such that rotation of the shaft 22 and the first crank arm 231 by actuation of the operating lever 24 in a first direction (R) (see FIG. 1) results in turning of the third crank arm 233 relative to the respective one of the left and right brackets 21 in the first direction (R) via the second crank arm 232, which, in turn, results in turning of the footrest 13 relative to the left and right brackets 21 in a second direction (S) opposite to the first direction (R) via the fourth crank arm 234, thereby stretching out the footrest 13 to an extended position relative to the left and right brackets 21, as best shown in FIGS. 1 and 3, and that rotation of the shaft 22 together with the first crank arm 231 via actuation of the operating lever 24 in the second direction (S) results in turning of the third crank arm 233 relative to the respective one of the left and right brackets 21 in the second direction (S) via the second crank arm 232, which, in turn, results in turning of the footrest 13 relative to the left and right brackets 21 in the first direction (R), thereby folding the footrest 13 to a retracted position relative to the left and right brackets 21, as best shown in FIGS. 2 and 4.

When the footrest 13 is disposed at the extended position, the fourth crank arm 234 extends along a line that passes through the pivot pin (A) such that the third crank arm 233 is prevented from turning in the first direction, thereby maintaining the footrest 13 stationarily at the extended position.

Figure 4:
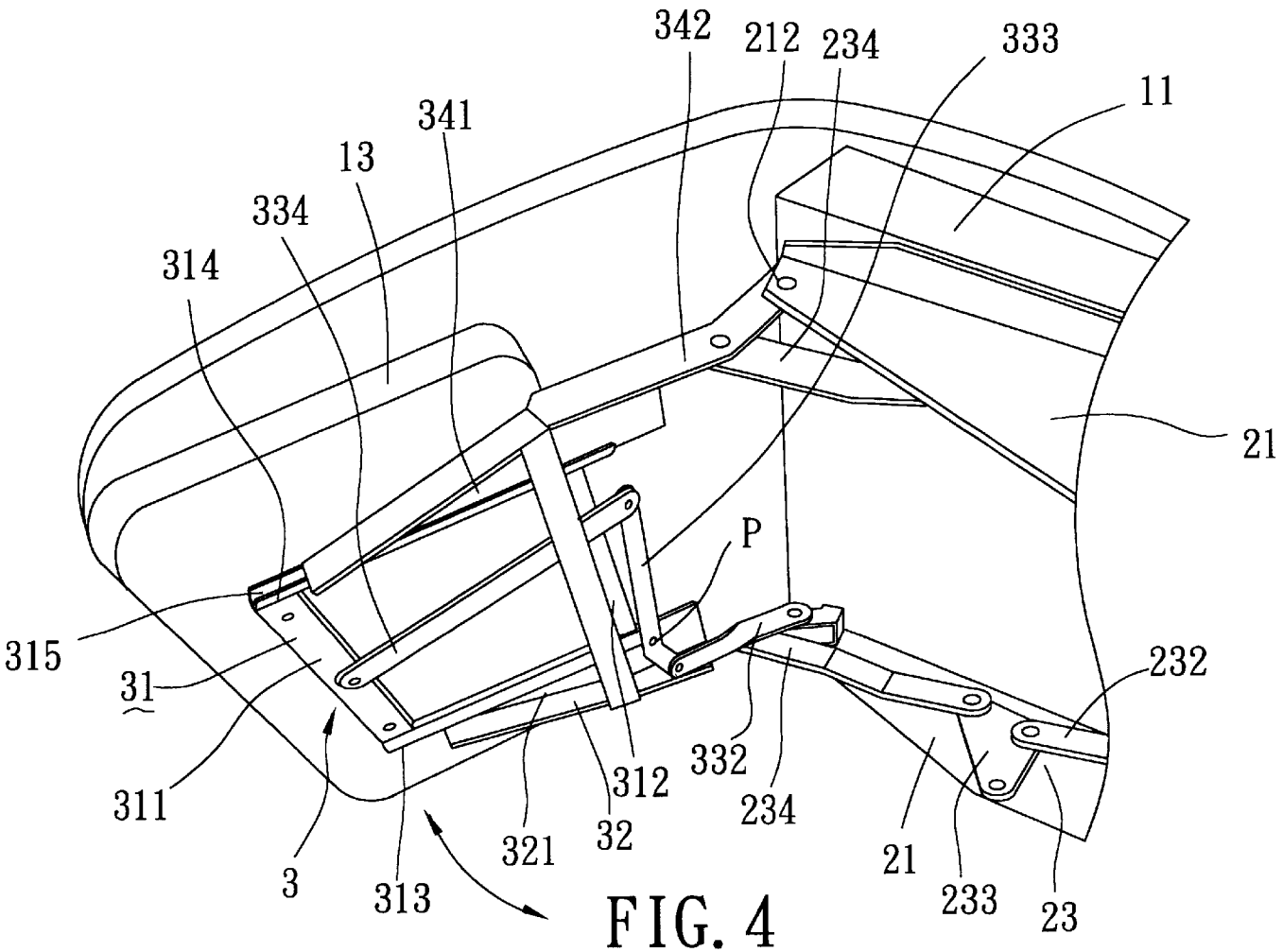
FIG. 4 is a fragmentary perspective bottom view of the preferred embodiment, illustrating the footrest at a semi-extended position.

With reference to FIG. 4, the support unit 3 includes a rack element 31, a generally U-shaped retention frame 32, and left and right connecting rods 342, 322. The rack element 31 is fixed to a bottom of the footrest 13, and has left and right sides 315 defining left and right rails 313, 314, and front and rear cross-bars 311, 312 interconnecting the left and right rails 313, 314. The retention frame 32 has left and right slide plates 321, 341 disposed slidably and respectively on the left and right rails 313, 314, and left and right connecting rods 342, 322 which extend integrally and respectively from the left and right slide plates 321, 341. Each of the left and right connecting rods 342, 322 is pivoted to the front end 211 of a respective one of the left and right brackets 21 and the front end of the fourth crank arm 234 of a respective one of the crank mechanisms 23 such that turning of the third crank arm 233 results in movements of the slide plates 321, 341 along the left and right rails 313, 314, thereby permitting stretching of the footrest 13 to the extended position.

The invention further comprises a stretch-out device which includes a swing lever 333, a push-and-pull rod 334, and a push arm 332. The swing lever 333 is disposed below the rack element 31 adjacent to the rear cross-bar 312, is pivoted to the right slide plate 321 about a pivot (P) (see FIG. 4), and has two distal ends at two opposite sides of the pivot (P). The push-and-pull rod 334 is disposed below the front cross bar 311, and has one end pivoted to the front cross-bar 311 and the other end pivoted to one of the distal ends of the swing lever 333. The push arm 332 has a first end pivoted to a respective one of the left and right brackets 21 and a second end pivoted to the other one of the distal ends of the swing lever 333 such that movement of the footrest 13 to the extended and retracted positions results in an upward turning of the push arm 332, which, in turn, results in swinging of the swing lever 333, which, in turn, results in frontward movement of the push-and-pull rod 334, thereby permitting full stretching of the footrest 13 relative to the seat 11.

Figure 5:
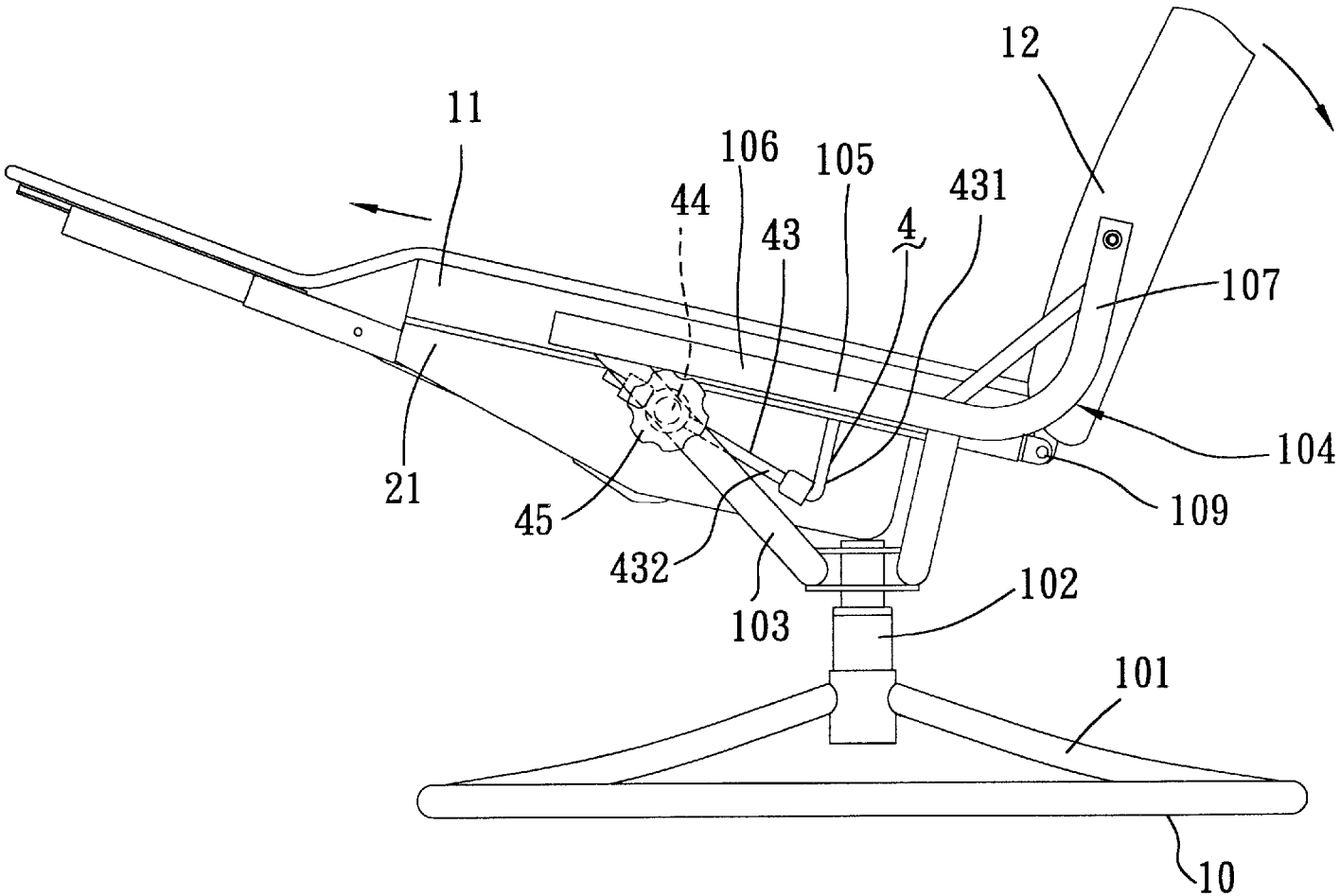
FIG. 5 is a schematic side view of the preferred embodiment, illustrating the state of a backrest relative to the seat prior to adjustment.
Figure 6:
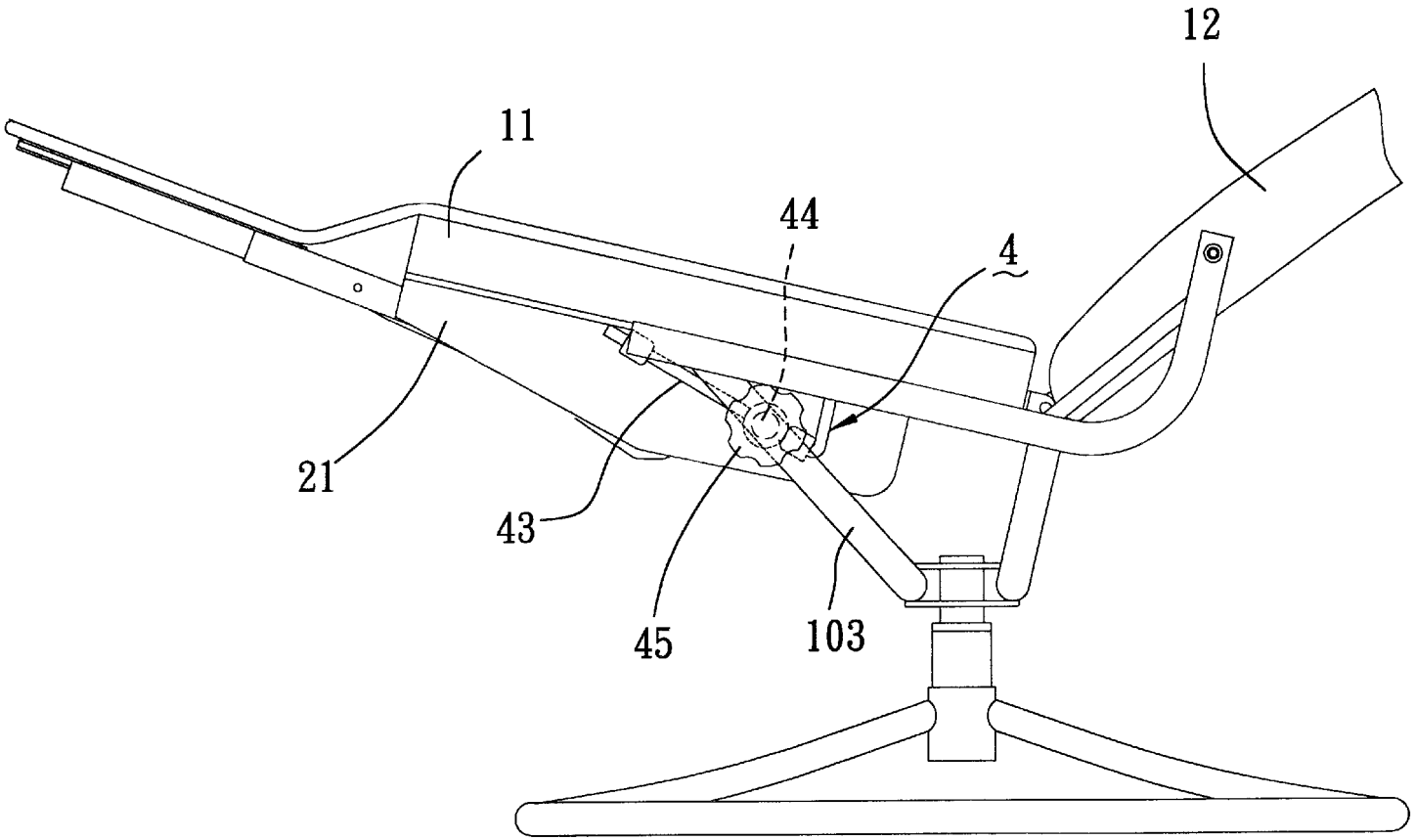
FIG. 6 is a schematic side view of the preferred embodiment, illustrating the state of the backrest relative to the seat after an inclination adjustment.

Referring to FIGS. 5 and 6, the seat base 10 includes a circular foundation 101 disposed on a floor surface, an upright post 102 rotatably mounted on the foundation 101, and a seat mounting unit 104 fixed onto the post 102 for co-rotation therewith relative to the foundation 101. The seat mounting unit 104 includes left and right tubular frame parts 103 fixed onto the post 102 via two fixing elements 106, and left and right L-shaped frame parts 105. Each of the L-shaped frame parts 105 includes a horizontal portion 106 that is secured to a respective one of the tubular frame parts 103, and a vertical portion 107 that extends from the horizontal portion 106 and that is pivoted to the backrest 12 above the horizontal pivot 109. The invention further includes an angle adjusting unit 4 which includes a transverse rod 44, left and right L-shaped slide rods 43, and a fastener knob 45. The transverse rod 44 is fixed to the left and right tubular frame parts 103, extends in the transverse direction, and is formed with two slide holes. Each of the left and right L-shaped slide rods 43 has a short rod section 431 that is secured to the bottom of the seat 11 and that is disposed rearwardly of the transverse rod 44, and a long rod section 432 that extends frontwardly and upwardly from the short rod section 431 through a respective one of the slide holes in the transverse rod 44. As such, pivotal action of the backrest 12 relative to the seat 11 results in frontward and rearward movement of the slide rods 43 and the seat 11 relative to the transverse rod 44. The fastener knob 45 is mounted threadedly on the transverse rod 44, and is movable between a locking position, in which the fastener knob 45 moves toward and abuts against a respective one of the slide rods 43, thereby immobilizing the seat 11 relative to the seat base 10, and an unlocking position, in which the fastener knob 45 moves away and disengages from the respective one of the slide rods 43, thereby permitting synchronous movement of the backrest 12 and the seat 11 relative to the seat base 10.

With this invention thus explained, it is apparent that numerous modifications and variations can be made without departing from the scope and spirit of this invention. It is therefore intended that the invention be limited only as indicated in the appended claims.

I claim:

1. A chair comprising:

a seat base;

a seat mounted on said seat base, extending in a longitudinal direction, and having left and right sides, front and rear ends, and a bottom;

a backrest disposed rearwardly of and connected to said seat;

a footrest disposed frontwardly of said seat;

a linkage mounting unit including left and right brackets fixed to said bottom of said seat and extending in said longitudinal direction, each of said left and right brackets having opposite front and rear ends;

a shaft mounted rotatably on said rear ends of said left and right brackets and extending in a transverse direction relative to said longitudinal direction;

an operating lever secured to said shaft for turning said shaft;

a support unit disposed below for supporting said footrest thereon; and a linkage unit interconnecting said seat and said support unit, and including a pair of crank mechanisms disposed at said left and right sides of said seat, respectively, each of said crank mechanisms including a first crank arm secured to said shaft for synchronous rotation therewith, extending transversely from said shaft and having a pivot end distal from said shaft, a second crank arm disposed frontwardly of said first crank arm and having a front end and a rear end pivoted to said pivot end of said first crank arm, a third crank arm of generally triangular shape disposed frontwardly of said second crank arm and having a first corner pivoted to a respective one of said left and right brackets, a second corner pivoted to said front end of said second crank arm and disposed above said first corner, and a third corner disposed above said first corner, and a fourth crank arm disposed frontwardly of said third crank arm and having a front end pivoted to said support unit and a rear end pivoted to said third corner of said third crank arm such that rotation of said shaft and said first crank arm via actuation of said operating lever in a first direction results in turning of said third crank arm relative to the respective one of said left and right brackets in said first direction via said second crank arm, which, in turn, results in turning of said footrest relative to said left and right brackets in a second direction opposite to said first direction via said fourth crank arm, thereby stretching out said footrest to an extended position relative to said left and right brackets, and that rotation of said shaft and said first crank arm via actuation of said operating lever in said second direction results in turning of said third crank arm relative to the respective one of said left and right brackets in said second direction via said second crank arm, which, in turn, results in turning of said footrest relative to said left and right brackets in said first direction via said fourth crank arm, thereby folding said footrest to a retracted position relative to said left and right brackets.

2. The chair as defined in claim 1, wherein said support unit includes a rack element fixed to said footrest and having left and right rails, a generally U-shaped retention frame having left and right slide plates disposed slidably and respectively on said left and right rails, and left and right connecting rods which extend integrally and respectively from said left and right slide plates, each of said left and right connecting rods being pivoted to said front end of a respective one of said left and right brackets and said front end of said fourth crank arm such that turning of said third crank arm results in movements of said slide plates along said left and right rails, said rack element further including front and rear cross-bars interconnecting said left and right rails, said chair further comprising a stretch-out device which includes a swing lever that is disposed below said rack element adjacent to said rear cross-bar, that is pivoted to one of said left and right slide plates about a pivot and that has two distal ends at two opposite sides of said pivot, a push-and-pull rod disposed below said front cross-bar and having one end pivoted to said front cross-bar and the other end pivoted to one of said distal ends of said swing lever, and a push arm having a first end pivoted to a respective one of said left and right brackets and a second end pivoted to the other one of said distal ends of said swing lever such that movement of said footrest to said extended position results in an upward turning of said push arm, which, in turn, results in swinging of said swing lever, which, in turn, results in frontward movement of said push-and-pull rod, thereby permitting full stretching of said footrest relative to said seat.

* * * * *